United States Patent [19]

Gillette

[11] 4,179,850

[45] Dec. 25, 1979

[54] REACTION HONING TOOL FOR HONING A FLAT SURFACE

[75] Inventor: Robert H. Gillette, Angola, Ind.

[73] Assignee: Brammall, Inc., Angola, Ind.

[21] Appl. No.: 897,937

[22] Filed: Apr. 19, 1978

[51] Int. Cl.[2] ..... B24B 7/00

[52] U.S. Cl. ..... 51/59 R; 51/281 R; 51/290; 51/330

[58] Field of Search ..... 51/57, 59 R, 60, 64, 51/281 R, 290, 330, 345; 407/69, 70

[56] References Cited

U.S. PATENT DOCUMENTS

| | | | |
|---|---|---|---|
| 1,141,095 | 6/1915 | Ackerman | 51/59 R |
| 1,885,119 | 11/1932 | Loewy . | |
| 1,904,049 | 4/1933 | Hoyt . | |
| 2,099,207 | 11/1937 | Hill et al. . | |
| 2,195,065 | 3/1940 | Wallace | 51/60 |
| 2,483,997 | 10/1949 | Gjertsen | 51/345 |
| 2,694,885 | 11/1954 | Peden . | |
| 2,764,854 | 10/1956 | Menken . | |
| 2,765,529 | 10/1956 | Bolender | 51/57 X |
| 3,195,280 | 7/1965 | Crowe . | |
| 3,339,313 | 9/1967 | Lindhag . | |
| 3,875,825 | 4/1975 | Buttafuoco . | |
| 3,882,646 | 5/1975 | Stritzel . | |

*Primary Examiner*—Nicholas P. Godici
*Assistant Examiner*—Robert P. Olszewski
*Attorney, Agent, or Firm*—Hill, Van Santen, Steadman, Chiara & Simpson

[57] ABSTRACT

Apparatus and method for honing internal surfaces of a workpiece wherein at least one of the surfaces to be honed is a flat or non-circular aperture. Movable honing stones are mounted in a holding tool such that they can move back and forth transversely of the honing tool as the honing tool is moved longitudinally of the surface to be honed. A first series of honing stones is mounted in a series of parallel slots formed in the honing tool at an angle such that when the tool moves in a first longitudinal direction the honing stones will move to one side of the tool due to reaction forces and due to the angle at which the mounting slots are formed in the tool. A second series of honing stones is mounted in a second plurality of parallel slots formed in the tool such that they move transversely in a direction opposite to the first plurality of stones when the tool is moved in a first longitudinal direction. The result is that the first and second plurality of stones alternately move back and forth transversely with respect to the tool as the direction of travel of the tool changes resulting in a very precise and effective honing operation as well as providing that the tools are self-cleaning. In a preferable arrangement the first and second plurality of stones are mounted in slots which are at an angle of 45° with the longitudinal axis of the tool.

26 Claims, 11 Drawing Figures

REACTION HONING TOOL FOR HONING A FLAT SURFACE

BACKGROUND OF THE INVENTION

1. Field of the Invention

This invention relates to the field of special purpose honing tools usable to hone flat surfaces in non-circular holes.

2. The Prior Art

While circular holes may be readily honed to precise dimensions, it has not been possible with prior art tools to efficiently hone flat surfaces to very precise dimensions in hard metals such as stainless steel. U.S. Pat. No. 2,694,885 discloses a honing tool utilizing rotary and reciprocal movement. U.S. Pat. No. 1,885,119 discloses a hand operated reciprocal honing tool. U.S. Pat. No. 3,875,825 discloses a ski sharpener. U.S. Pat. Nos. 3,339,313 and 2,764,854 disclose hand operated razor blade sharpeners. U.S. Pat. Nos. 2,099,207; 3,195,280 and 3,882,646 disclose various rotary housing devices.

SUMMARY OF THE INVENTION

The invention comprises a tool upon which is mounted a series of honing stones for the purpose of honing the flat sides of holes or apertures in hard metals such as stainless steel or inconel. The stones are mounted on tool holders which in turn slide in slots present in the tool. The stones are set at 45° angles to the direction of travel of the tool itself and are set at 90° or are parallel with respect to one another. A reciprocal driving device imparts a forward and backward motion to the tool which is positioned within the piece of metal with flat surfaces to be honed adjacent to the honing stones. As the tool is driven forward and backward bringing the flat top surfaces of the honing stones into contact with the workpiece, the reaction forces present upon the stones in the tool holders cause them to be driven back and forth at an angle to the reciprocal motion. This off angle stroke action blends with the reciprocal motion of the tool and the flat cutting surface hones the metal very precisely. Since the stones are set on 90° angles with respect to one another, or parallel to one another, a given reaction force drives one set of stones in one direction and the other set in a second direction. The process reverses when the tool moves in the opposite direction. The basic height of the tool may be altered slightly by means of adjustment cones which can be driven forward or retracted from adjusting pins by means of a threaded arbor through the center of the tool.

A second embodiment of the tool uses four sets of stones to hone two flat, parallel surfaces simultaneously. Whereas the initial embodiment requires only two sets of stones to hone two surfaces simultaneously. By using four sets of stones, the width of the work piece being honed may be substantially increased for a given size stone.

Larger apertures may be honed by combining several smaller tools together.

DESCRIPTION OF THE PREFERRED EMBODIMENTS

Not by way of limitation, but for the purpose of disclosing the best mode of carrying out my invention and for the purpose of enabling one skilled in the art to practice my invention, several embodiments of my invention are disclosed in detail in FIGS. 1 through 12.

Figure 1:
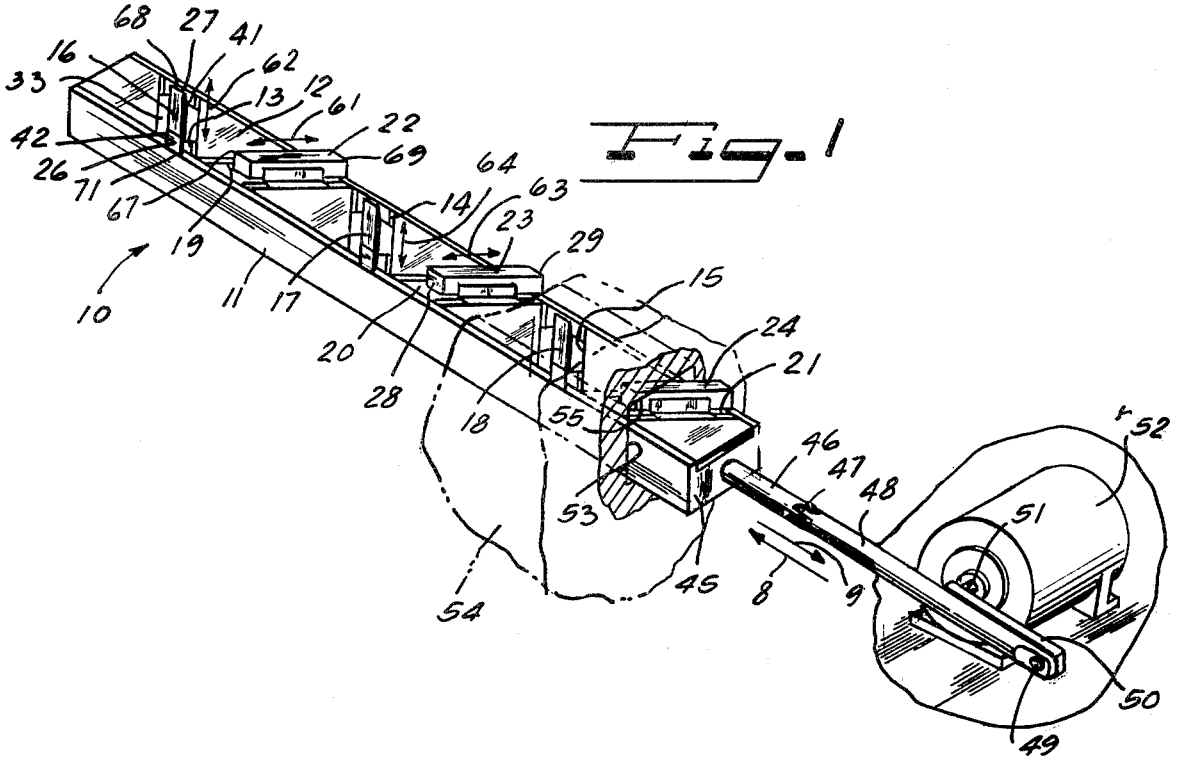
FIG. 1 is an isometric view of a tool having one set of honing stones, effective to hone one flat, parallel surface.
Figure 2:
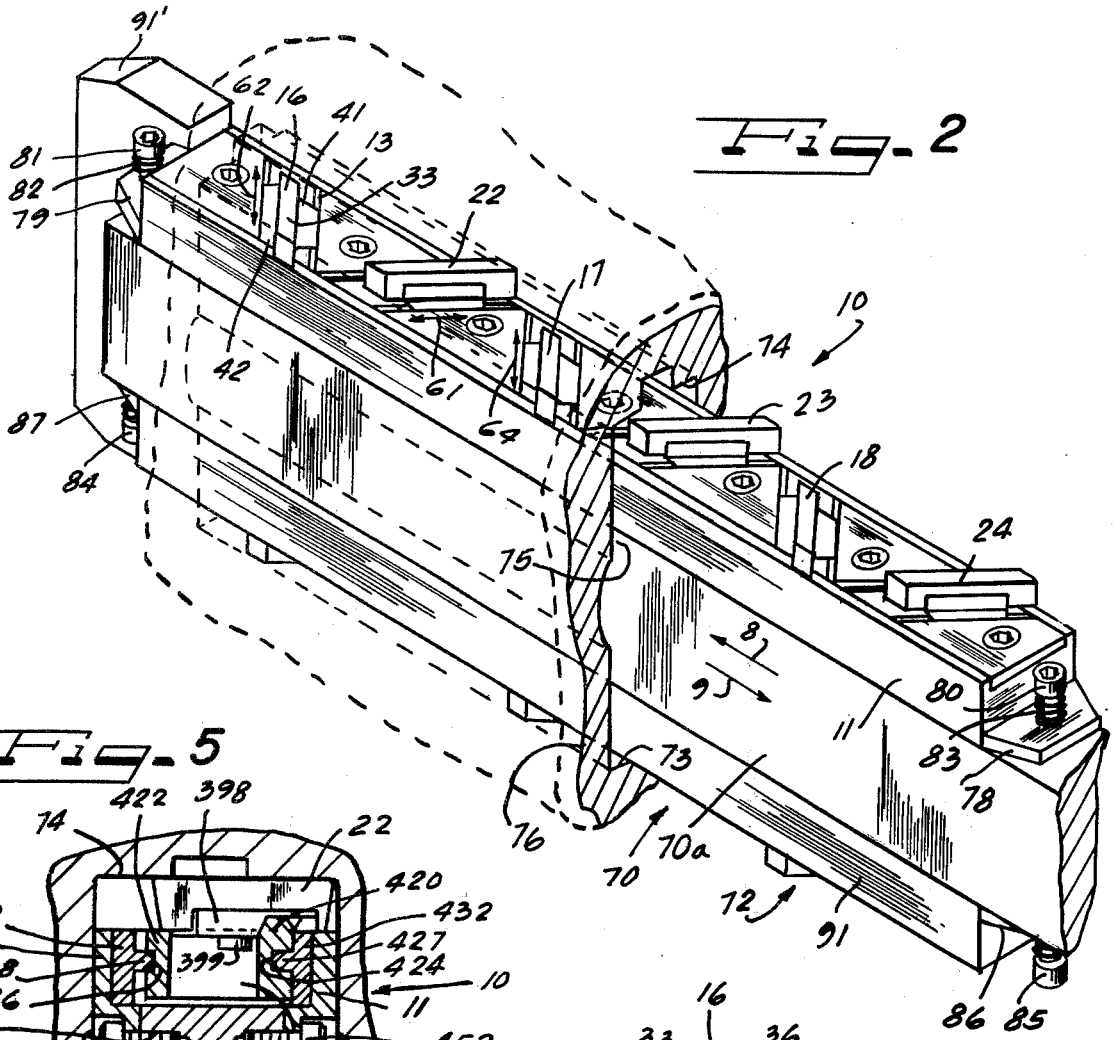
FIG. 2 is an isometric view of a tool having two sets of honing stones effective to hone two flat, parallel surfaces within a work piece.
Figure 6:
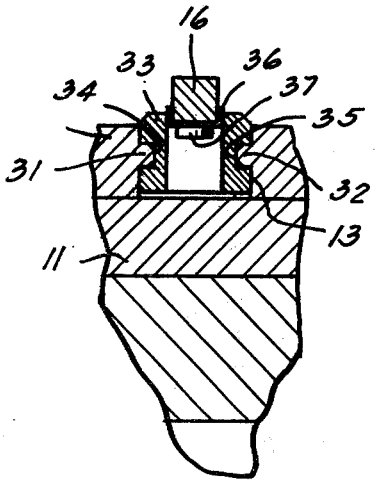
FIG. 6 is a section through a honing stone and tool holder taken along the line VI—VI of FIG. 3.
Figure 3:
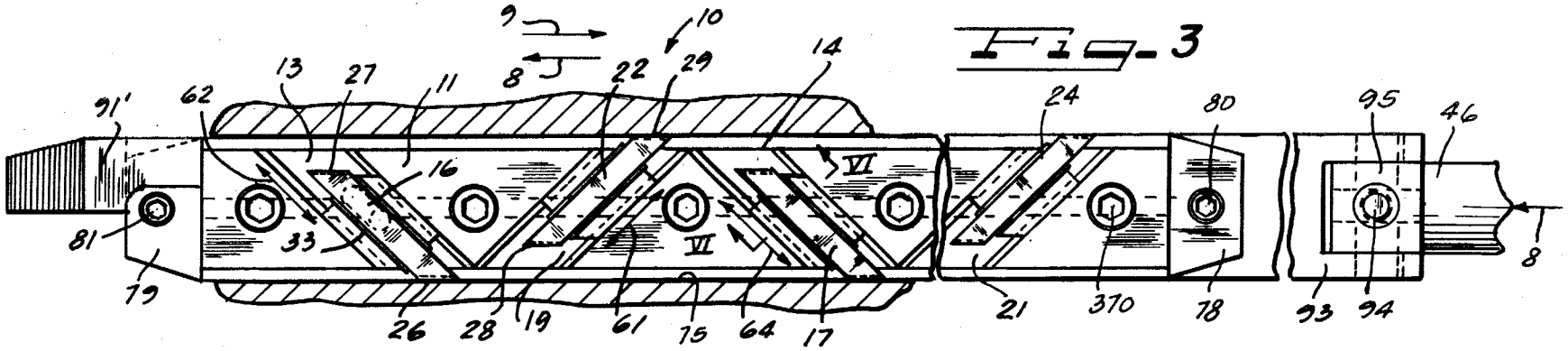
FIG. 3 is a planar top view of the tool of FIG. 2.
Figures 7, 8, 9, 10, 11:
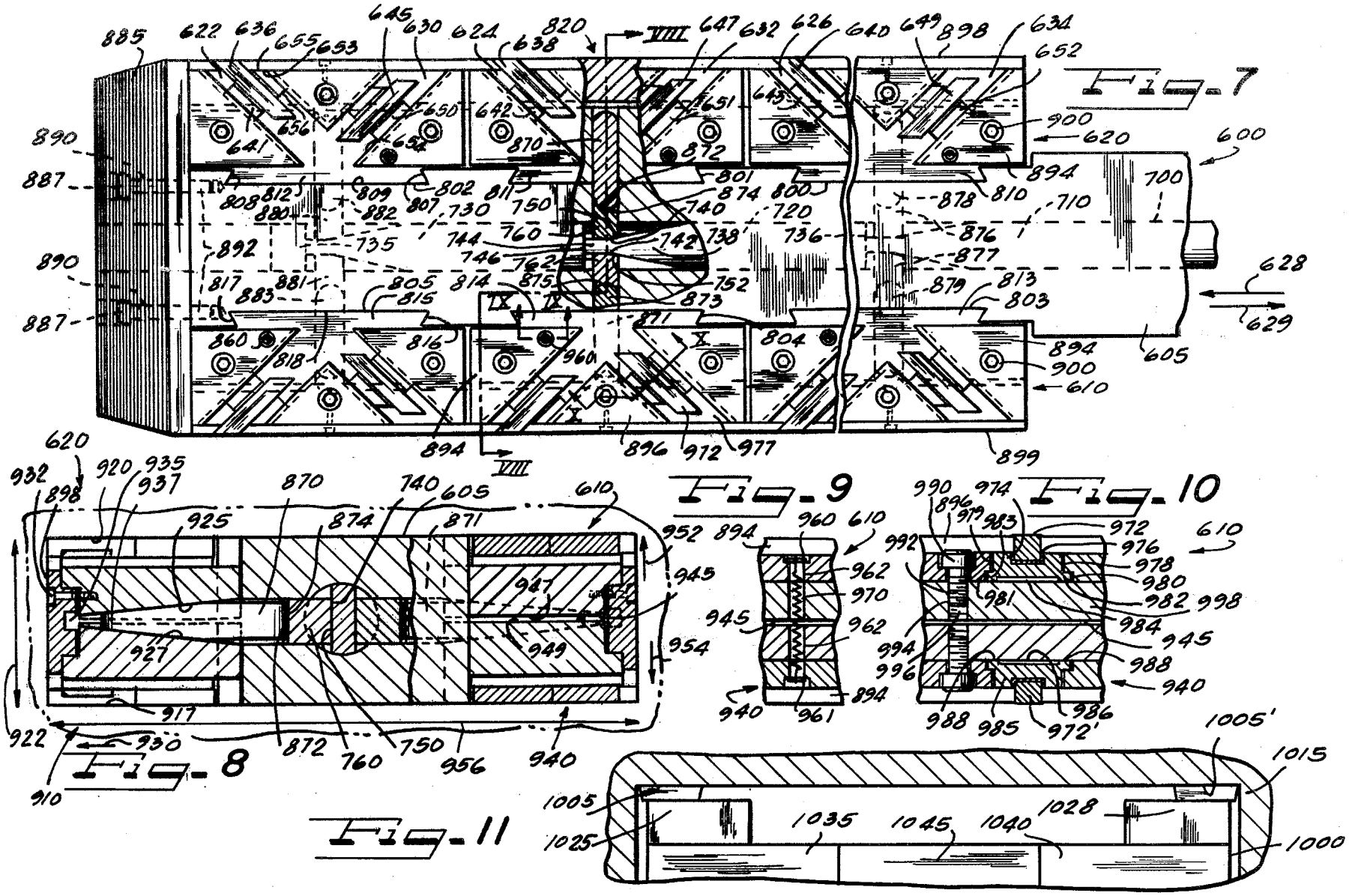
FIG. 7 is a planar top view of a second embodiment of the invention.
FIG. 8 is a section taken along line VIII—VIII of the tool of FIG. 7.
FIG. 9 is a section taken along line IX—IX of the tool of FIG. 7 showing expansion detail.
FIG. 10 is a section taken along line X—X of the tool of FIG. 6 illustrating the two sets of honing stones mounted in tool holders.
FIG. 11 is a planar frontal view of an extra large workpiece with two flat surfaces being honed by a combination of two tcols of the type shown in FIG. 7.

FIGS. 1, 2, 3 and 6 illustrate the principles of the invention with FIG. 1 being a general disclosure and FIGS. 2, 3 and 7 illustrating practical embodiments. As shown in FIG. 1, a main body portion 11 of the tool 10 has a first surface 12 in which a plurality of parallel slots 13, 14 and 15 are formed portraying a first plurality of honing stones 16, 17, and 18. A second plurality of slots 19, 20, and 21 are formed in the tool 11 parallel to each other and spaced between the slots 13, 14, and 15 in an alternate manner and slidably support the second plurality of honing tools 22, 23 and 24. As can be seen in FIGS. 1 and 3 the stones 16, 17 and 18 have their opposite ends such as ends 26 and 27 of stones 16 formed so that they are parallel to each other and parallel to the longitudinal axis of the tool 10. Also the second plurality of stones 22, 23 and 24 have their opposite ends as for example the ends 28 and 29 of stone 23 formed parallel to each other and parallel to the longitudinal axis of the tool 10.

Each of the stones are supported relative to the tool body 11 and the slots in which the tools are mounted as shown in FIG. 6. The slot 13 for example has a pair of projecting ribs 31 and 32 which project inwardly from opposite sides of the slot 13 and the tool 16 is mounted in a carrier 33 which is formed with slots 34 and 35 which are slidably received on the ribs 31 and 32. Standing between the sides of the tool carrier 33 is a U-shaped holder 36 which has an attaching means 37, such as a set screw for example which passes through the member 36 and into the tool 16 so as to hold it in position. As can be observed from FIGS. 1 and 2 the members 33 have ends of 41 and 42 which conform to the ends 26 and 27 of the tool 16.

One end 45 of the tool 10 is connected to a piston rod 46 which is connected by pivot pin 47 to a shaft 48 that is in turn connected by a pivot pin 49 to a crank arm 50 which is mounted on the shaft 51 of a motor 52. As the motor 52 is energized the shaft 51 rotates turning the crank arm 50 and driving the tool 10 back and forth as shown by the arrows 8 and 9. The tool is inserted in an opening 53 of a workpiece 54 which has a surface 55 as illustrated in FIG. 1 which is to be honed. The length of the tool 10 is such that it extends through the opening 53 and as the tool 10 is moved backwards and forth in the opening 53 of the workpiece 54 the tools 16 through 18 and 22 through 24 hone the surface 55 with the tools 16, 17 and 18 moving back and forth in the direction of the arrows 61 and 62 and the tools 22, 23 and 24 moving back and forth in the direction of the arrows 63 and 64.

In operation as motor 52 is energized the reaction force due the back and forth movement of the tool 10 causes the honing stones to move back and forth as indicated by the arrows 61 through 64 and the surface 55 will be honed. As honing occurs the corner such as corners 67, 68, 69 and 71 of the stone will take on a radius as for example 50/1000". In a practical embodiment honing has been accomplished with strokes in the range of 40 to 70 strokes a minute and the stroke length has been the length of the bore of the opening being honed less the tooling plus two inches. The tool is never allowed to move completely out of the aperture while honing. A pressure is applied by the tool against the workpiece so as to insure proper honing but the pressure is not so great as to interfere with the sliding action of the tool in the slots.

The action of the honing surfaces of the stones against the surface 53 is at an angle to the direction of travel and is analogous to the operation of sharpening a knife on a sharpening stone which provides that the surfaces of the stones in contact with the surface being honed are self-dressed. The preferred material for the holders or guides 33 is nylon.

FIG. 2 illustrates a pair of honing tools 10 and 70 mounted on opposite sides of a spacer member **70*a* and the resulting tool 72 can be used to simultaneously hone surfaces 73 and 74 which are opposed parallel surfaces in the opening 75 in the workpiece 76. The tool 10 is formed with a pair of flanges 78 and 79 at opposite sides thereof and a pair of bolts 80 and 81 pass through openings formed in the flanges and hold the tool 10 to the member 71. Springs 82 and 83 are now between the head of the bolts 80 and 81 and the flanges 78 and 79 so as to spring bias the tool 10 toward the member 71. Corresponding bolts 84 and 85 pass through flanges 86 and 87 to hold the tool 70 to the lower surface of member 71**.

A guide member 91' is mounted on the front of assembly so as to guide the nose of the tool into the opening 75.

The honing is accomplished by operating the tool back and forth in the opening 75 for a predetermined time and the surfaces 73 and 74 will be honed parallel to each other.

The tool of 72 is driven by a shaft 46 which is connected to an end 93 of the tool by a suitable pin 94 on a standard universal block 95 as shown in FIG. 3.

Figure 4:
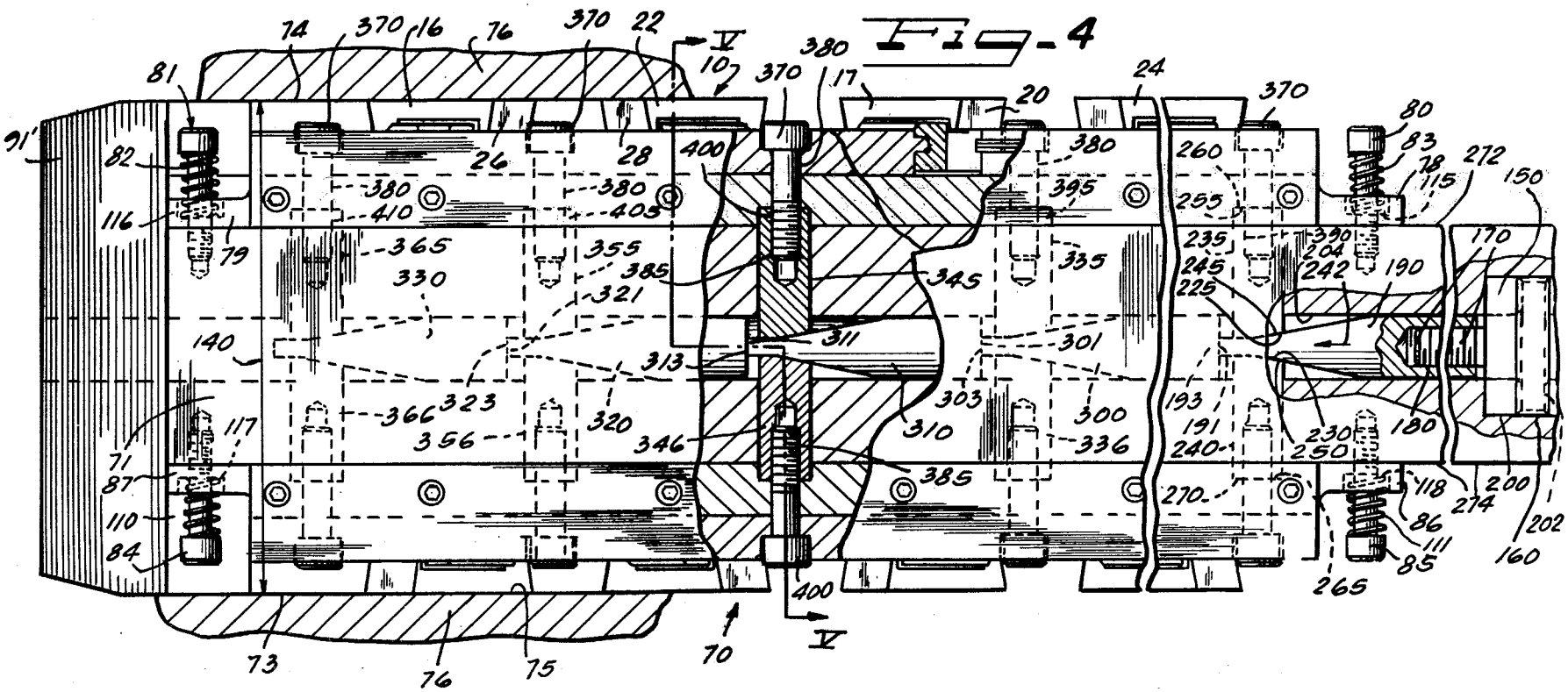
FIG. 4 is a planar, fragmentary side view of the tool of FIG. 2.

FIG. 4 comprises a partly cut away side view of the tool 72 of FIG. 2 and illustrates the relationship between the elements of the device. It is desirable to provide means for moving the stones on tool 10 away from the stones on tool 70 so that as honing occurs cut surfaces having different spacings between them can be honed to a finished tolerance as desired. FIG. 4 illustrates the relationship between the support 11 for one set of honing stones and tool 10 and the support 91 for the second set of honing stones of tool 70. It further illustrates the details of the expansion mechanism whereby the effective distance between tools 10 and 70 may be continually increased. As can be seen from FIG. 4, the tool body 71 supports the tools 10 and 70 which are held in position with respect to the body 71 by the two sets of bolts 80, 81 and 84, 85. The bolts are spring-loaded with a set of springs 82, 83 and 110, 111 which apply force against the heads of each of the bolts 80, 81, 84, 85 and apply force against a set of slots 115, 116, 117, 118 which have cut in each of the flanges 78, 79 and 86, 87.

The effective height 140 of the tool 72 is altered or maintained in a given workpiece 76 by means of a thrust bearing 150, and a feed thread arbor 160. The feed thread arbor 160 has a set of threads 170 which correspond to a set of threads 180 which are at one end of the tapered member 190. The feed thread arbor 160 is retained in a boring 200 adjacent to the thrust bearing 150 by conventional retaining means. The feed thread arbor 160 has an engageable head 202 which is of a conventional variety which can engage a rotary arbor of a conventional type on the reciprocating means. When engaged, the feed thread arbor 160 is turnable by the arbor and in so doing is screwed or unscrewed onto the tapered member 190 by means of the threads 170 which mate with the threads 180. The tapered member 190 which is in a boring 204 in the tool body 70 has a second end that has a pair of tapered, flat bearing surfaces 225 and 230 which engage a set of expansion pins 235 and 240. As the flat bearing surfaces 225 and 230 are driven forward into the tool 70 in a direction 242 by the action of the feed thread arbor 160 with threads 170 acting on the threads 180 of the tapered member 190, a pair of bearing surfaces 245 and 250 on the expansion pins 235 and 240 cause the expansion pins 235 and 240 to move perpendicular to the direction of motion of the tapered member 190. This perpendicular motion is coupled via the expansion pins 235 and 240 to the tools 10 and 70. An end 255 of the expansion pin 235 bears against a surface 260 of the tool 10 supporting the upper set of honing stones. A similar surface 265 on the expansion pin 240 bears against a surface 270 of the tool 70 supporting the other set of honing stones. The action of the surface 255 against the surface 260 forces the tool 10 away from a surface 272 of the body 71. Similarly, the action of the surface 265 against the surface 270 forces the tool 70 away from the surface 274 of the body 71.

The effect of the springs 82, 83, 110 and 111 associated with the bolts 80, 81 and 84, 85 is to bias the tools 10 and 70 back into their undisturbed position, hence the tools 10 and 70 move under the action of the tapered member 190 as it is being driven in the direction 242. To produce equal motion along the length of the structures 32 and 36 in a direction vertically away from the tool body 48, a series of tapered members 300, 310, 320 and 330 are employed each of which is driven laterally in the direction 242 due to the action of the prior member. Each tapered member has associated with it an analogous pair of expansion pins 335, 336; 345, 346; 355, 356; and 365, 366. In particular, each of said members has a front surface 191, 301, 311, and 321, which bears against the rear surface 193, 303, 313 and 323 of the next corresponding cylindrical member 300, 310, 320 and 330 respectively.

Thus, as can be seen, under the influence of the feed thread arbor 160, the tapered members 190, 300, 310, 320 and 330 are all driven in the direction 242 simultaneously causing the tools 10 and 70 supporting the honing stones to be moved in a direction perpendicular to the direction 242. The continual adjustment in the effective height 140 of the tool 72 will continue so long as the feed thread arbor 160 is rotated. It should be noted, that the tool 10 is affixed to the expansion pins 235, 335, 345, 365, by a set of bolts 370 which pass through borings 380 of the tool 70 and engage a set of threads 385 in a set of borings 390, 395, 400, 405, and 410 which are located in the expansion pins 235 335, 345, 355 and 365, respectively. A corresponding set of bolts, borings, and threads affixes the tool 70 to the expansion pins 240, 336, 346, 356 and 366.

Figure 5:
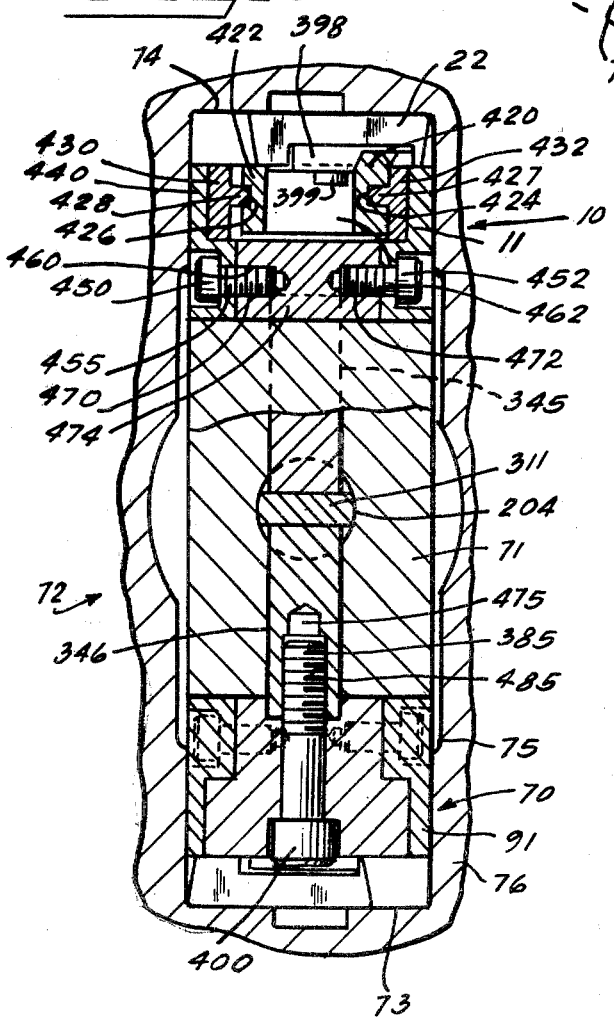
FIG. 5 is a section taken along line V—V of FIG. 3 showing a cross-section of the tool of FIG. 2.

FIG. 5, a section taken along line V—V of FIG. 4, illustrates the relationship between a stone guide 398, with a clamp screw 399, the expansion pin 345, and a bolt 400 which retains the tool 70 to the expansion pin 346. As may be noted from FIG. 5, the stone 22 is supported in the stone guide 398 which in turn rides on brackets 420, 422 each having a grooved surface 424, 426 which interlock with tongues 427, 428 which are an integral part of flanges 430, 432. The flange 430 is held in position by a face plate 440 by a bolt 450 which passes through a body hole 455, has a set of threads 460 which engage a set of threads 470 in a body member 474 of the tool 10. The tool 10 is symmetrical and the identical flange 432 is held in place by the face plate 11 and the locking bolt 452 with threads 462 which engage threads 472 of the body 474 of the tool 10. Additionally, FIG. 5 illustrates the threads 385 in a boring 475 which match a set of threads 485 on the bolt 400. The tool 70 has a construction which is a mirror image of the construction previously discussed for the tool 10.

FIG. 7 illustrates a tool 600 which utilizes four of the basic honing tools of FIG. 1, so that four surfaces may be honed simultaneously. A central member 605 supports a tool 610 and a tool 620 of the type disclosed in FIG. 1. Beneath the tools 610 and 620 are another pair of unseen tools, also analogous to the tool of FIG. 1 which are oriented to hone a second pair of flat, parallel surfaces. As was the case in FIG. 1, the tool 620 has a series of slots 622, 624, 626, at a 45° angle to the two directions of reciprocal travel, 628, 629. A set of slots 630, 632, 634 is orthagonal to the slots 622, 624, 626 and alternates with them. A set of cutting stones 636, 638, 640 slides back and forth in the slots 622, 624, 626 on a set of guides 641, 642, 643. A corresponding set of stones 645, 647, 649 slides back and forth in the set of slots 645, 647, 649 on a set of guides 650, 651, 652.

The honing action occurs in the same way as was previously discussed with respect to FIGS. 1 and 2. The structure of the tool 610 and the two lower, unseen tools is identical. As a typical honing stone, 636 slides back and forth, it encounters stops 653 and 654 which limit its travel. A surface 655, on the tool guide 641 encounters the stop 653. Another surface 656 encounters the stop 654 to limit the motion of the honing stone 636. Similar surfaces on the guides 642, 643, 650, 651 and 652 limit the travel of the associated honing stones 638, 640, 645, 647 and 649.

The mechanism of maintaining the effective height of the tool 600 while honing the work surfaces is slightly different from the expansion structure used for the tool of FIG. 2. The tool body 605 has a boring 700 extending therethrough within which is positioned a set of tapered members 710, 720 and 730 with a stop 735. A typical tapered member 720 has a flat end 736 and a tapered end 738. The tapered end 738 has a pair of bearing surfaces 740 and 742 and a front extension 744 with a flat surface 746. The tapered members 710, 720 and 730 are driven laterally through the boring 700 as was discussed with respect to FIG. 4 by a feed thread arbor not shown but of the same variety as disclosed with respect to FIG. 4.

The tool body 605 of FIG. 7 has cut into it a set of guides 800, 801, 802, 803, 804 and 805 which enable the tools 610 and 620 to be moved vertically with respect to the direction of tool travel 628 or 629. A typical guide has a pair of angular surfaces 807, 808 joining a surface 809. Each guide 800, 801, 802, 803, 804 and 805 interlocks with a corresponding member 810, 811, 812, 813, 814, 815 of which 815 is a typical example. The member 815 has a pair of angular surfaces 816, 817 joined by a third flat surface 818. The tools 810 and 820 move in the guides 803, 804, 805 and 800, 801, 802, respectively. The typical expansion pins 760, 762 cooperate with a pair of tapered wedges 870, 871 having convex ends 872, 873 which interlock with concave ends 874, 875 of the expansion pins 760, 762.

There is a corresponding set of expansion pins and wedges associated with each bearing surface of the other two tapered members 710 and 730. The tapered member 710 has a pair of expansion pins 876, 877 and an associated pair of tapered wedges 878, 879. The tapered member 730 has a pair of expansion pins 880, 881 and an associated pair of tapered wedges 882, 883. The expansion pins and wedges associated with the tapered members 710, 730 operate as do those associated with the tapered member 720.

The tool body 605 also has a nose guide 885 affixed thereto by a set of bolts 887 which pass through the nose guide 885 through borings 890 and which are received into a threaded boring 892 of the tool body 605. The top surfaces of the tools 610 and 620 are covered by a set of plates of which 894, 896 are typical. Face plates 898, 899 are mounted perpendicular to the covering plates 894 and 896 which are held onto the tools 610 and 620 by screws 900.

FIG. 8 illustrates a cross section taken along line VIII—VIII of FIG. 7 and discloses the relationship between the top and bottom tool carrying surfaces of the tool body 605 as well as the expansion mechanism which maintains or alters the effective height of the tool 600. FIG. 8 shows the tool 620 which is positioned along one side of the tool body 605 and a corresponding tool 910 which is positioned along the other side of the tool body 605, having an identical construction to the tool 620 but operable to hone an edge 917 as opposed to an edge 920 that the tool 620 hones. In order to maintain the effective height 922 of the tool 600, the tapered wedge 870 which has the bearing surface 872 which bears against the bearing surface 874 of the expansion pin 760 is used. The tapered wedge 870 has further bearing surfaces 925 and 927 aligned such that as the tapered expansion pin 870 is driven in the direction 930 under the effect of the expansion pin 760 the two tools 620 and 910 are driven in a direction perpendicular to the direction 930 thereby maintaining the effective height 922 of the tool. The face plate 898 is affixed to the tool 620 by a screw 932. The face plate 898 has a slot 935 into which the end 937 of the tapered expansion pin 870 is allowed to expand.

FIG. 8 also illustrates a partial section of the tool 610 and a second identical tool 940 supported on the opposite side of the tool body 605. A gap 945 between the surfaces 947 and 949 of the tools 610 and 940 respectively discloses the separation between the upper tool 610 and the lower tool 940 required so that the two tools may move in the direction 952 or 954 to thereby maintain the effective height 922 of the tool 600.

FIG. 9 a cross section taken along line IX—IX of FIG. 7 discloses a pair of spring loaded pins 960, 961 which bias the two tools 610 and 940 toward one another. A boring 962 extends through the body of each of the tools 610 and 940. A spring 970 connects the two pins 960 and 961 together. Thus, the two tools 610 and 940 are held together and are driven apart only to the extent that the tapered expansion wedges 870 and 871 separate them.

FIG. 10, a section taken along line X—X is a section perpendicular to a typical honing stone and tool guide. A typical honing stone 972 is supported in a guide 974 by a clamp 976. The guide 974 rides in a slot 977 having surfaces 978, 979 with grooves 980, 981 into which tongues 982, 983 of the guide 974 slide. There is an open region 984 under the slide 974 which minimizes friction. A second identical guide 985 with a stone 972' slides in a groove 986 on a pair of surfaces 988 on the tool 940. The plate 896 is indicated with a screw 990 having threads 992 which engage a set of threads 994 in the boring 996 in a member 998 of the tool 610.

Figure 12:
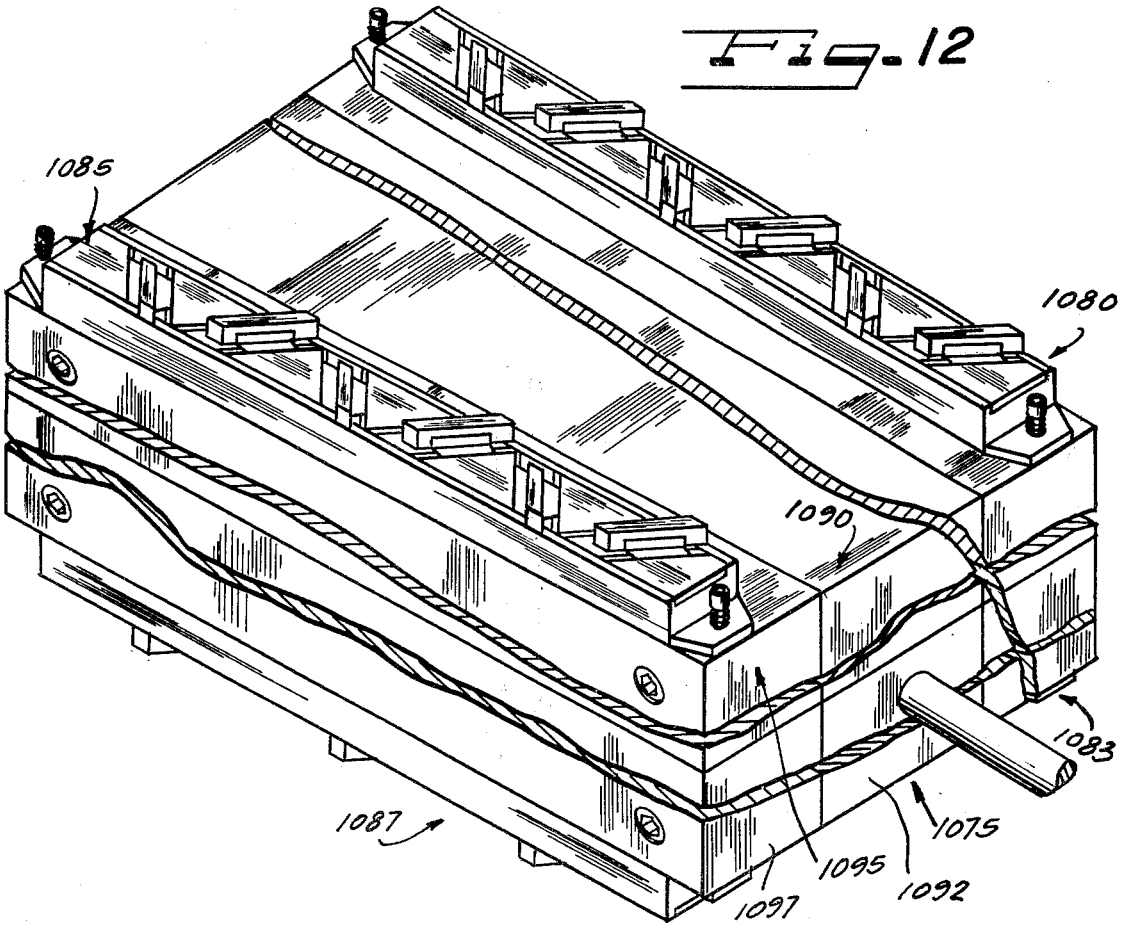
FIG. 12 is a fragmentary isometric view of a very large aperture being honed by a combination of four tools.

FIG. 11 illustrates a third variation of the use of the invention where extra wide apertures are to be honed. A wide aperture 1000 is shown having a surface 1005 and 1005' to be honed. A modification of the tool of FIG. 2 or FIG. 7 is indicated in FIG. 11 in that a pair of tools 1025 and 1028 corresponding to the tool of FIG. 1 are mounted on a member 1035 and a member 1040. The members 1035 and 1040 are connected to a third member 1045 which is a filler member whose prime purpose is to position the members 1035 and 1040 to the position corresponding to the width of the aperture 1000. Using the dummy filler member 1045 in combination with cutting members such as 1025 and 1028 the flat surfaces of large apertures may be honed simultaneously. Additional combinations of active cutting and passive filler members may be used to hone four surfaces simultaneously of a large aperture. FIG. 12 shows a large composite tool 1075 composed of a set of tools 1080 and 1083, 1085 and 1087 of the type generally as shown in FIG. 1 properly spaced by a set of spacer elements 1090, 1092, 1095 and 1097.

It should be noted that as the tool moves back and forth under the control of the driving means, the corners of the honing stones take on a 50/1000" radius.

With respect to stroke rate, the best known range is 40–70 strokes/minute. The stroke length is the length of the bore being honed, less the tool length plus two inches. Pressure applied by the tool against the work piece must be adequate to insure proper honing but not so great as to interfere with the sliding action of the tool in the guides.

Although various modifications might be suggested by those skilled in the art, it should be understood that I wish to embody within the scope of the patent warranted hereon all such modifications as reasonably and properly come within the scope of my contribution to the art.

I claim as my invention:

1. A reaction honing tool for honing a flat surface of a workpiece comprising:

a body member movable in a longitudinal direction; first means for honing mounted on said body member so as to move back and forth, relative to said body member, due to reaction forces, which result from a change of motion, from a first direction to an opposite direction, of the body member; said first means for honing being oriented at a first angle with respect to said first direction;

said first angle being between 0° and 90°.

2. The reaction honing tool according to claim 1 having further:

second means for honing mounted on said body member so as to move back and forth, relative to said body member, due to reaction forces, as the body member moves in said first direction and opposite said first direction; said second means for honing being oriented at a second angle with respect to said first direction of longitudinal motion;

said second angle being between 0° and 90°.

3. The reaction honing tool according to claim 1 having a first plurality of means for honing;

each member of said plurality of means for honing being movably mounted at an angle defined with respect to said first direction;

each said member of said first plurality being mounted so as to move back and forth, relative to said body member, due to reaction forces, as the body member moves in said first direction and opposite said first direction;

each said angle of each said member of said first plurality being between 0° and 90°.

4. The reaction honing tool according to claim 3 having a second plurality of means for honing:

each member of said second plurality being movably mounted at an angle defined with respect to said first direction of motion;

each said member of said second plurality being mounted so as to move back and forth, relative to said body member, due to reaction forces as the body member moves in said first direction and opposite said first direction;

each said angle of each said member of said second plurality being between 0° and 90°.

5. The reaction honing tool according to claim 2, wherein said first angle and said second angle each have a value of forty-five degrees.

6. The reaction honing tool according to claim 4, wherein each said angle of each said member of said first plurality and each said angle of each member of said second plurality have a value of forty-five degrees.

7. The reaction honing tool according to claim 4, wherein as the tool moves in said longitudinal direction, said first and second pluralities of means for honing operatively contact the flat surface of the workpiece being honed, as the tool moves in a direction opposite to said longitudinal direction, said first and second pluralities of means for honing operatively contact the flat surface of the workpiece being honed.

8. The reaction honing tool according to claim 4, wherein each said member of said first and second pluralities of means for honing is slidably mounted in a nylon tool guide.

9. A reaction honing tool for honing a flat surface for use with a source of reciprocal motion comprising:

a tool body;

means for linking said tool body to the source of reciprocal motion;

first means for honing;

said tool body having connection means so as to be linkable operatively to the source of reciprocal motion so that said tool body may be caused to move linearly over a limited distance in a first direction and then opposite thereto in a reciprocal fashion;

a first surface defined on said tool body such that a vector normal to said first surface would also be perpendicular to said first direction of motion;

said first means for honing being movably mounted on said first surface with a limited range of linear motion relative to said first surface of said tool body with the direction of linear motion being substantially at a first selected angle with respect to the direction of reciprocal motion;

said first means for honing being operative to move, in response to reaction forces due to a change of motion from said first direction to a direction opposite said first direction from a first end of said limited range of linear motion to a second end thereof, and to move in response to reaction forces due to a change of motion from said direction—opposite said first direction—to said first direction, from a second end of said limited range of linear motion to a first end thereof.

10. The reaction honing tool of claim 9, having further:

a second surface on said tool body substantially parallel to said first surface;

second means for honing;

said second means for honing being mounted on said second surface analogously to the mounting of said first means for honing on said first surface of said tool body.

11. The tool according to claim 10 having further:

spreader means operable to move said first and second parallel surfaces laterally with respect to each other.

12. The reaction honing tool according to claim 11, wherein said spreader means comprises a series of tapered members slidingly mounted in a boring through said tool body.

13. The reaction honing tool according to claim 11, wherein each said means for honing comprises a honing stone operatively mounted in a slidable nylon tool guide.

14. The reaction honing tool according to claim 11, wherein said first selected angle corresponds to a 45° angle.

15. The reaction honing tool according to claim 11, wherein said second selected angle corresponds to a 90° angle.

16. The reaction honing tool according to claim 10, wherein said first and second means for honing each comprises a honing stone of rectangular cross section.

17. A reaction honing tool for use with a source of reciprocal motion comprising:

a tool body;

first, second, third and fourth pluralities of means for honing;

each of said plurality of means for honing being divided into a first and second group;

said tool body having connection means so as to be linkable operatively to the source of reciprocal motion so as to cause said tool body to move linearly over a limited distance in a first direction and then opposite thereto in a reciprocal fashion;

a first surface defined on said tool body such that a vector normal to said first surface would also be perpendicular to said first direction of motion;

a second surface defined on said tool body, laterally displaced with respect to said first surface and parallel thereto;

said first surface having a first and second region defined thereon;

said second surface having a first and second region defined thereon;

each of said members of said first group of said first plurality being movably mounted on said first region with a limited range of linear motion with respect to said first region of said first surface with the direction of said linear motion being at a first selected angle with respect to the direction of reciprocal motion;

each of said members of said second group of said first plurality being movably mounted on said first region with a limited range of linear motion with respect to said first region of said first surface with the direction of said linear motion being at a second selected angle with respect to said direction of linear motion of said members of said first group;

each said member of said first and second groups of said second plurality of means for honing being mounted analogously on said second region of said first surface as each said member of said first and second groups of said first plurality is mounted on said first region;

each said member of said first and second groups of said third plurality of means for honing being mounted analogously on said first region of said second surface as each said member of said first and second groups of said first plurality is mounted on said first region;

each said member of said first and second groups of said fourth plurality of means for honing being mounted analogously on said second region of said second surface as each said member of said first and second groups of said first plurality is mounted on said first region;

each member of each of said first groups being operative to move, in response to reaction forces due to motion in said first direction from a first end of said limited range of linear motion to a second end thereof simultaneously while each member of each of said second groups is operative to move, in response to said reaction forces due to said motion in a first direction, from a second end of said limited range of linear motion to a first end thereof and in response to reaction forces due to said motion opposite to said first direction, each member of each of said first groups being operative to move from said second end of said limited range of linear motion to said first end thereof simultaneously with each member of each of said second groups being operative to move from said first end of said limited range of linear motion to said second end thereof.

18. The reaction honing tool according to claim 17, having further, spreader means operable to move said first and second parallel surfaces laterally with respect to each other.

19. The reaction honing tool according to claim 18, wherein said spreader means comprises a series of tapered members slidingly mounted in a boring through said tool body.

20. The reaction honing tool according to claim 18, wherein each said member of said first, second, third and fourth plurality of means for honing comprises a honing stone operatively mounted in a slidable nylon guide.

21. The reaction honing tool according to claim 17, wherein said first selected angle corresponds to a 45° angle.

22. The reaction honing tool according to claim 17, wherein said second selected angle corresponds to a 90° angle.

23. The reaction honing tool according to claim 17, wherein said first and second groups of said first, second, third, and fourth pluralities of means for honing have equal numbers of members.

24. The reaction honing tool according to claim 19, having further spreader means such that said first and second surfaces are laterally movable with respect to one another.

25. The honing tool according to claim 7, wherein said members of said first group of said first, second, third and fourth pluralities are mounted alternating with said members of said second group of said same first, second, third and fourth pluralities.

26. The method of honing flat surfaces with a tool having honing means mounted thereon movable relative to the tool at an angle with respect to the direction of longitudinal motion of the tool comprising:

positioning the tool so that the honing means is in operative contact with the flat surface of the workpiece to be honed;

moving the tool longitudinally with the honing means in contact with the flat surface being honed;

reversing the direction of longitudinal tool motion; simultaneously moving the honing means relative to the tool forward at an angle to the longitudinal direction of motion of the tool;

moving the tool longitudinally in the reverse direction with the honing means in contact with the flat surface being honed;

reversing the direction of longitudinal tool motion; simultaneously moving the honing means relative to the tool backward at an angle to the longitudinal direction of motion of the tool.

* * * * *